US005265420A

United States Patent [19]

Rutschmann

[11] Patent Number: 5,265,420

[45] Date of Patent: Nov. 30, 1993

[54] EXHAUST SYSTEM OF A MULTI-CYLINDER RECIPROCATING ENGINE

[75] Inventor: Erwin Rutschmann, Tiefenbronn, Fed. Rep. of Germany

[73] Assignee: Dr. Ing. h.c.F. Porsche AG, Fed. Rep. of Germany

[21] Appl. No.: 886,237

[22] Filed: May 21, 1992

[30] Foreign Application Priority Data

May 21, 1992 [DE] Fed. Rep. of Germany ..... 4116493

[51] Int. Cl.[5] ..... F01N 3/28; F01N 7/02; F01N /7/04

[52] U.S. Cl. ..... 60/302; 60/323; 181/240

[58] Field of Search ..... 60/302, 323, 324, 299; 181/240

[56] References Cited

U.S. PATENT DOCUMENTS

| | | | |
|---|---|---|---|
| 2,072,961 | 3/1937 | Nelson . | |
| 2,940,249 | 6/1960 | Gospodar | 181/240 |
| 3,070,187 | 12/1962 | Deremer . | |
| 3,872,843 | 3/1975 | Steinmüller | 60/302 |
| 4,359,865 | 5/1990 | Sakuma | 60/323 |
| 4,926,635 | 11/1982 | Nakao et al. | 60/323 |

FOREIGN PATENT DOCUMENTS

| | | | |
|---|---|---|---|
| 506100 | 11/1951 | Belgium . | |
| 0314129 | 3/1989 | European Pat. Off. . | |
| 152115 | 9/1983 | Japan | 60/302 |

*Primary Examiner*—Douglas Hart
*Attorney, Agent, or Firm*—Evenson, McKeown, Edwards & Lenahan

[57] ABSTRACT

The exhaust gases of both cylinder banks of a multi-cylinder reciprocating engine first flow through a catalyst situated along the respective cylinder bank and then, in a cross countercurrent, flow through a horizontally situated muffler arranged transversely to the cylinder banks.

17 Claims, 2 Drawing Sheets

1
2
3
4
5
6
7
8
9
10
11
14
14F
14R
15
15F
15R
16
17
18
Z1
Z2
Z3
Z4
Z5
Z6
Z7
Z8
E1
E2
E3
E4
E5
E6
E7
E8

EXHAUST SYSTEM OF A MULTI-CYLINDER RECIPROCATING ENGINE

BACKGROUND AND SUMMARY OF THE INVENTION

This invention relates to an exhaust system of a multi-cylinder reciprocating engine comprising two cylinder banks, particularly for a V-type engine having a muffler disposed horizontally and transversely with respect to the cylinder banks.

An exhaust system of this type is generally known from the U.S. Pat. No. 3,070,187. The exhaust gases of the two cylinder banks situated in the driving direction are introduced into two mufflers situated transversely with respect to the vehicle. Perforated sections of exhaust pipes from which the exhaust gases are released into the open air on the rear side of the motor vehicle are disposed in both mufflers.

It is an object of the invention to alter such an exhaust system in such a manner that the required mufflers and catalytic converters can be housed in a very narrow space.

This object is achieved according to preferred embodiments of the invention by providing an arrangement wherein the exhaust gases of both cylinder banks first flows through a catalytic converter which is adjacent to and disposed in parallel to the cylinder banks and subsequently flows in a counterflow through the muffler. If the exhaust gases of the two cylinder banks flow in a reverse flow through a transverse muffler disposed transversely to the cylinder banks, by means of an expedient arrangement behind the engine, a short overall length of the exhaust system and of the engine can be achieved. A compact construction with respect to space is also promoted by the fact that the catalysts and the main mufflers are situated alongside the cylinder banks. Such an exhaust system is optimally suitable for a V-engine which is arranged in the rear end of the vehicle. However, such an exhaust system also has an advantageous effect on the space in the case of mid-engines according to other contemplated embodiments.

By means of a suitable dimensioning of the overall volumes of the catalytic converters and of the mufflers in adaptation to the overall displacement of the cylinders, an exhaust gas system with a low loss of pressure and good muffling can be created despite a multiple deflection of the exhaust gas flows.

Other objects, advantages and novel features of the present invention will become apparent from the following detailed description of the invention when considered in conjunction with the accompanying drawings.

DETAILED DESCRIPTION OF THE DRAWINGS

Figure 1:
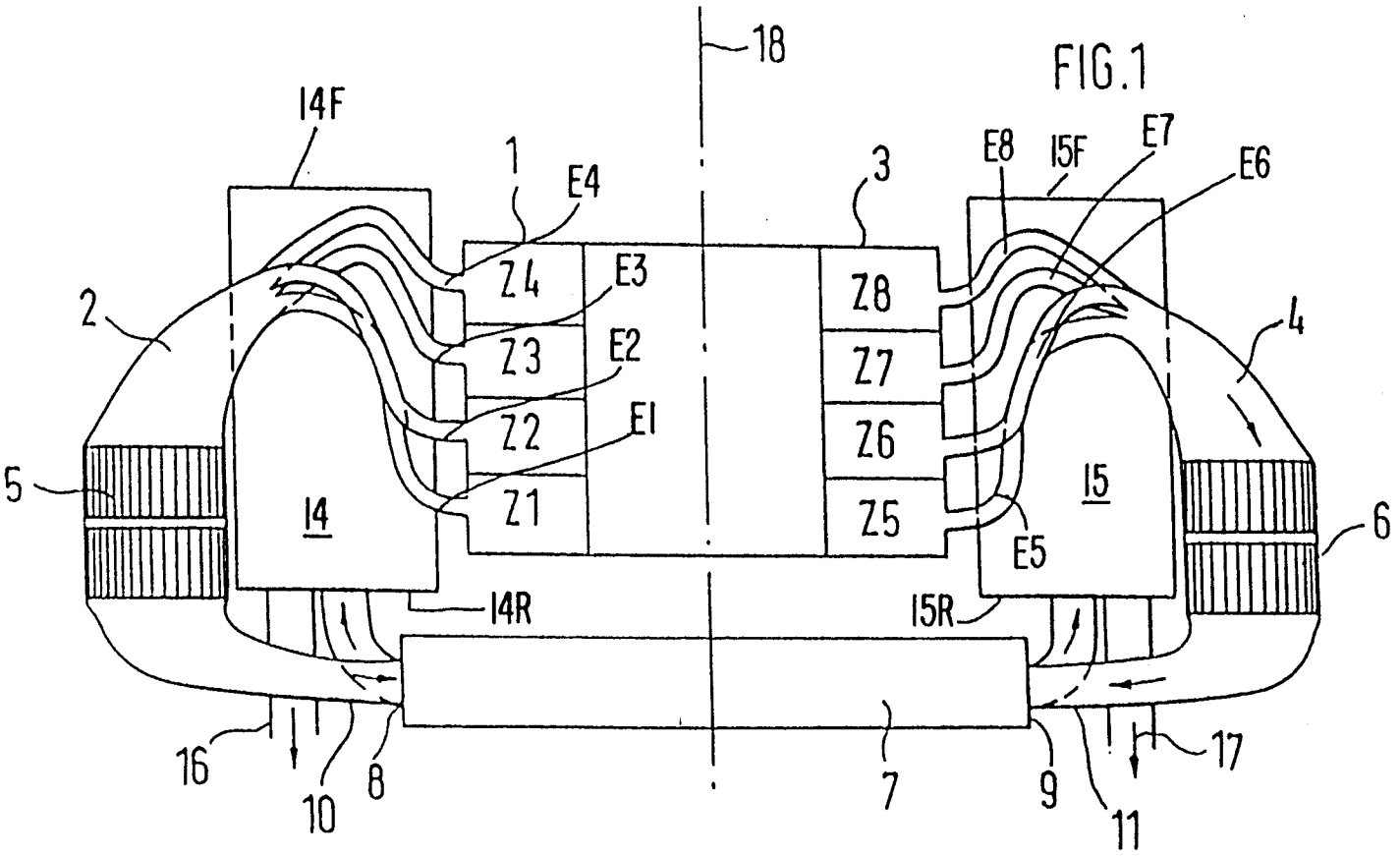
FIG. 1 is a schematic top view of an exhaust system on a V8-engine constructed according to a preferred embodiment of the invention.
Figure 2:
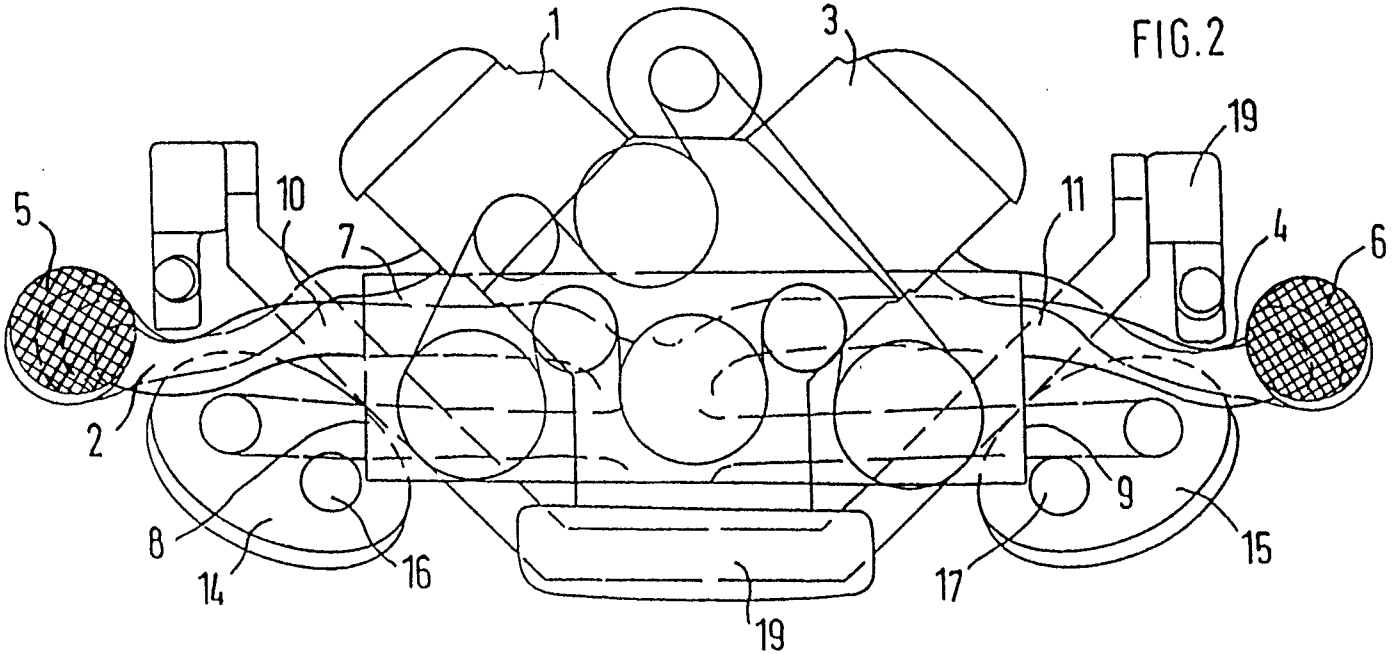
FIG. 2 is a schematic rear view of the exhaust system of FIG. 1.

Four exhaust pipes E1, E2, E3, and E4, which combine in a manifold 2, start out from a left cylinder bank 1 of an 8-cylinder V-engine comprising cylinders Z1, Z2, Z3, Z4. The four exhaust pipes E5, E6, E7, and E8 of the right cylinder bank 3 comprising cylinders Z5, Z6, Z7, Z8 combine in the manifold 4. Catalytic converters 5 and 6 are inserted into both manifolds 2 and 4, the longitudinal axes of the catalytic converters being situated in parallel to the cylinder banks 1 and 3, which are parallel to the engine longitudinal centerline 18.

The exhaust gas, which was purified in the catalytic converters 5, 6, will then arrive in a transversely extending front muffler 7 and flows through it in two opposed exhaust gas flows. At the two end faces 8 and 9 of muffler 7, the exhaust flow pipes 10, 11 enter into a jacket pipe 13 which encloses the two exhaust pipes 10, 11. In order to achieve an intensive mixing of the exhaust gas flows and a good muffling, the two exhaust pipes are separated in the center area 12 into two sections 10', 10'' and 11', 11'' At the outlets to sections 10'and 11', the sections 10' and 11' are bent at right angles with respect to one another and are provided with nozzle-shaped end pieces 10'N, 11'N and are arranged with respect to one another in such a manner that the exhaust gases travel in a cross countercurrent with respect to one another.

Figure 3:
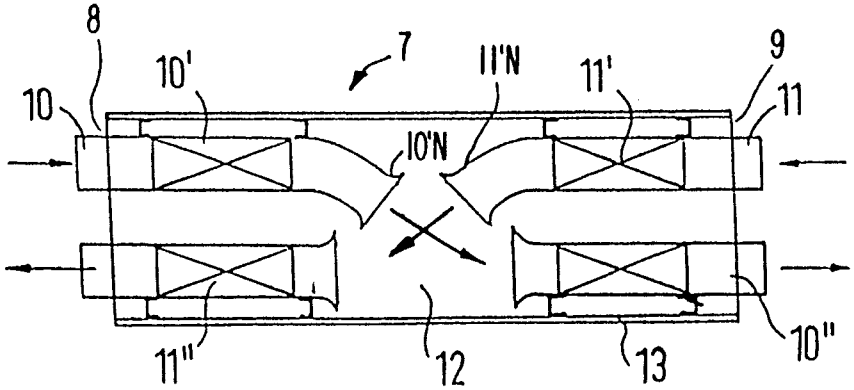
FIG. 3 is a schematic view of front mufflers of the exhaust system of FIGS. 1 and 2.

After they are released from the front muffler 7, the exhaust gases arrive in the main mufflers 14 15 which are situated in parallel to the cylinder banks. They enter the main mufflers from the rear 14R, 15R, turn by 80° on the front side 14F, 15F, and in the rear 14R, 15R enter into the respective end pipes 16, 17 which open back out into the open air. The whole exhaust system is constructed symmetrically with respect to the longitudinal center axis 18 of the engine. The left and right catalysts 5, 6 each have equal dimensions and are disposed at the same distance with respect to the longitudinal center axis 18. The exhaust gases of one cylinder bank flow through the main muffler adjacent to the other cylinder bank. In order to minimize the flow resistance despite the multiple sharp deflections, the volumes of the jacket pipes surrounding the mufflers and the catalysts are quire large. In an especially preferred embodiment, the ratio of the total catalytic converter volume $V_{Kat}$ to the overall operating displacement volume of the cylinders $V_H$ is 1.4; the ratio of the overall muffling volume $V_D$ to the overall displacement $V_H$ amounts to 14. The large-volume main mufflers 14, 15 are arranged below the level of the two cylinder banks as shown schematically in FIG. 3 so that they do not result in the requirement of increasing the fitting length of the engine.

The engine together with the exhaust system is disposed on an engine mount 19 in the center of the motor vehicle. The engine mount 19 is integrated into the axle structure (subframe) of the motor vehicle.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An exhaust system for a multi-cylinder reciprocating engine with two cylinder banks, comprising:

a transverse muffler disposed horizontally and transversely with respect to the cylinder banks, having sides parallel to the cylinder banks with an inlet and an outlet on each of said sides;

a plurality of catalytic converters, each of which is adjacent to and disposed parallel to one of the cylinder banks and connected between said one of the cylinder banks and one of said inlets, wherein exhaust gases of both cylinder banks first flow through the catalytic converters nd subsequently flow through the transverse muffler;

passage means within said transverse muffler to provide a flow of exhaust gases from the in the inlets to the outlets in substantially opposite directions within said transverse muffler; and a plurality of main mufflers, each of which is parallel and adjacent to one of said cylinder banks and connected to one of said outlets, wherein exhaust gases of one cylinder bank emerging from the transverse muffler flow through one of said main mufflers situated adjacent to the other cylinder bank.

2. An exhaust system according to claim 1, wherein the transverse muffler is disposed at the rear end of the two cylinder banks.

3. An exhaust system according to claim 1, wherein each of the main mufflers has an inlet at the rear, and has an outlet at the rear connected to an end pipe leading into open air.

4. The exhaust system according to claim 3, wherein the transverse muffler is disposed at the rear end of the two cylinder banks.

5. An exhaust system according to claim 4, wherein the main mufflers re arranged below the cylinder banks symmetrically with respect to the transverse muffler and to the center longitudinal axis of the engine.

6. An exhaust system according to claim 1, wherein a jacket pipe, which is closed on said sides, surrounds the transverse muffler, and wherein the passage means uses two parallel pipes arranged in the jacket pipe.

7. An exhaust system according to claim 6, wherein the pipes are parallel and each enter the jacket pipe on a respective one of said sides, are bent at an angle with respect to one another in a center area, and exit out of the other one of said sides.

8. An exhaust system according to claim 7, wherein the pipes are interrupted in the center area and form two sections.

9. An exhaust system according to claim 8, wherein the exhaust gas streams from the pipes intersect in the center area to allow exhaust gas from one of the pipes to mix with exhaust gas of an other one of the pipes in the center area.

10. An exhaust system according to claim 1, wherein the ratio of the overall volume of the catalytic converters to the overall displacement of all cylinders amounts to approximately 1/10 of the ratio of the overall muffler volume to the overall displacement.

11. An exhaust system according to claim 8, wherein the ratio $$\frac{V_{Kat}}{V_H} \approx 1.4 \text{ and the ratio } \frac{V_D}{V_H} \approx 14.$$

12. An exhaust system according to claim 1, wherein the ratio of the overall volume of the catalytic converters to the overall displacement of all cylinders amounts to approximately 1/10 of the ratio of the overall muffler volume to the overall displacement.

13. An exhaust system according to claim 12, wherein the ratio $$\frac{V_{Kat}}{V_H} \approx 1.4 \text{ and the ratio } \frac{V_D}{V_H} \approx 14.$$

14. An exhaust system according to claim 1, wherein a jacket pipe, which is closed on said sides, surrounds the transverse muffler, and wherein the passage means uses two parallel pipes arranged in the jacket pipe.

15. An exhaust system according to claim 14, wherein the pipes are parallel and each enter the jacket pipe on a respective one of said sides, are bent at an angle with respect to one anther in a center area, and exit out of the other one of said sides.

16. An exhaust system according to claim 15, wherein the pipes are interrupted in the center area and form two sections.

17. An exhaust system according to claim 16, wherein the exhaust gas streams from the pipes intersect in the center area to allow exhaust gas from one of the pipes to mix with exhaust gas of an other one of the pipes in the center area.

* * * * *